United States Patent [19]

Imazeki et al.

[11] 4,357,604

[45] Nov. 2, 1982

[54] VARIABLE SIZE CHARACTER DISPLAY

[75] Inventors: Ryoji Imazeki; Seiichi Hattori, both of Hachioji; Yutaka Mizuno, Hino, all of Japan

[73] Assignee: Fujitsu Fanuc Limited, Tokyo, Japan

[21] Appl. No.: 26,247

[22] Filed: Apr. 2, 1979

[30] Foreign Application Priority Data

Apr. 14, 1978 [JP] Japan ..... 53-44035

[51] Int. Cl.[3] ..... G09G 1/16

[52] U.S. Cl. ..... 340/731; 340/749

[58] Field of Search ..... 340/731, 749, 748, 744, 340/723, 720, 750; 178/15, 30

[56] References Cited

U.S. PATENT DOCUMENTS

| | | | |
|---|---|---|---|
| 4,078,249 | 3/1978 | Lelke et al. | 340/731 |
| 4,090,188 | 5/1978 | Soga | 340/731 |
| 4,107,786 | 8/1978 | Masaki et al. | 340/731 |
| 4,129,860 | 12/1978 | Yonezawa et al. | 340/731 |

*Primary Examiner*—Marshall M. Curtis

*Attorney, Agent, or Firm*—Staas & Halsey

[57] ABSTRACT

In a character display in which dot data is read out, by a character address and a row address, from a character generator having stored therein each character in the form of dots and applied to a display unit in synchronism with dot clock pulses to provide a display of the character. There are provided means for frequency dividing the dot clock and character clock pulses and means for controlling the step-by-step advancement of the row address, whereby a character display of a desired size is provided.

4 Claims, 4 Drawing Figures

VARIABLE SIZE CHARACTER DISPLAY

BACKGROUND OF THE INVENTION

1. Field of the Invention

This invention relates to improvements in a character display employing a cathode ray tube (CRT).

2. Description of the Prior Art

In conventional CRT character displays, it is customary that the size of a character to be displayed is predetermined and cannot be changed at will. It would be convenient if the size of the character to be diplayed could be altered in accordance with the number of characters or the importance of the content to be displayed. One possible method of having character size is to change the scanning speed and the amount of vertical deflection of a beam of the CRT display. In principle, the size of the character can be altered in this manner, but in practice, it is difficult to change the scanning speed and the amount of vertical deflection of the beam.

It has been suggested, in the case of displaying a character by reading out a dot storage pattern from a character generator, that the size of the character to be displayed be altered by exchanging the dot storage pattern with a desired one; but this necessitates the modification of stored data and the modification is not easy.

FIG. 1 shows in block form a conventional character display and FIG. 2 is explanatory of its operation.

In FIG. 1, reference character RM indicates a refresh memory; CRTC designates a CRT controller; CG identifies a character generator; PSC denotes a parallel-serial converter; CRMC represents a CRT monitor signal control circuit; DOTC shows a dot clock generator; CHC refers to a character clock generator; MPX indicates a multiplexor; AB designates an address bus; DB shows a data bus; PRM identifies a parameter memory; RAS denotes a row address selector; and CAS represents a character address selector.

In the case of providing a display of one picture in which one character is formed with seven bits in a horizontal direction and nine bits in a vertical direction, the following method is employed. In the refresh memory RM there is stored character data to be displayed on the display surface of the cathode ray tube. The addresses of the refresh memory RM correspond to the character positions (defined by rows and columns) on the display surface, and the stored content of the refresh memory RM represents a character to be displayed. The character generator CG has stored therein data indicating the dot positions in rows R1 to R9 for all characters which can be displayed, and when supplied with the character data from the refressh memory RM, that is, a character address CA, and a row address RA from the CRT controller CRTC, the character generator CG provides 7-bit dot position information to the parallel-serial converter PSC.

The number of characters a to be displayed for each line, the number of lines b for each picture and the number of rasters c (the number of rows) for each character are prestored in the parameter memory PRM of the CRT controller CRTC via the data bus DB. The CRT controller CRTC reads out of the refresh memory RM a character to be displayed in a first line to apply the character address CA to the character address selector CAS and, at the same time, provides one pulse signal as address information to the row address selector RAS to retain it in a first row select state. As a consequence, the dot data of a first row of the first line is successively provided to the parallel-serial converter PSC, the output from which is applied to the CRT monitor signal control circuit CRMC in synchronism with a dot clock DOTC in FIG. 2 and used as a video signal VIDEO.

The selection of each character is performed in synchronism with character clock pulses CHC in FIG. 2 and when the count value of the character clock pulses CHC is detected by comparison to match with the number of the character a in the parameter memory PRM, it is confirmed that the display operation of the first row of the first line is completed. At this time, the CRT controller CRTC provides one pulse as row address information to the row address selector RAS to advance the row address by one step, by which the selector RAS is switched to the state of a second row selection, and then the same operations as described above are repeated.

When the count value of the character clock pulses CHC coincides with the number of displayed character a in a ninth row select state, it indicates the completion of the display operation for the first line, and the CRT controller CRTC successively accesses to characters of a second line to read them out of the refresh memory RM. Thereafter the display operation is similarly conducted for each of the b lines, thus completing one scanning and display operation for one picture. In FIG. 1, reference character H indicates the horizontal deflection output and V the vertical deflection output.

SUMMARY OF THE INVENTION

An object of this invention is to provide a character display in which the size of a character to be displayed can easily be changed as desired without changing the deflection speed and the amount of deflection of a beam and without modifying the stored content of the character generator.

Briefly stated, in the character display of this invention dot data is read out of a character generator having stored therein characters in the form of dots. The dot date is read out by using a character address and a row address, and is applied to a display part in synchronism with a dot clock to display the character. Means for frequency dividing the dot clock pulses and the pulses of a character clock and means for controlling the step advancement of the row address are provided.

DESCRIPTION OF THE PREFERRED EMBODIMENTS

Figure 2:
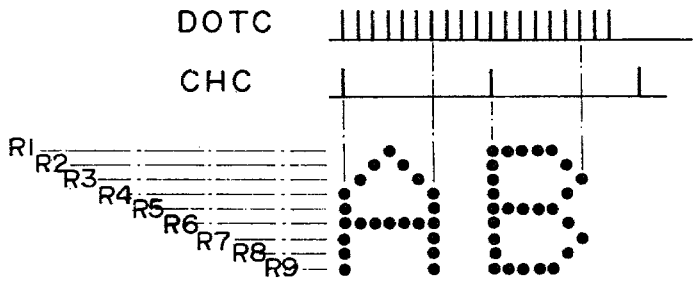
FIG. 2 PRIOR ART
FIG. 2 is explanatory of the principles of the conventional display device of FIG. 1.
Figure 3:
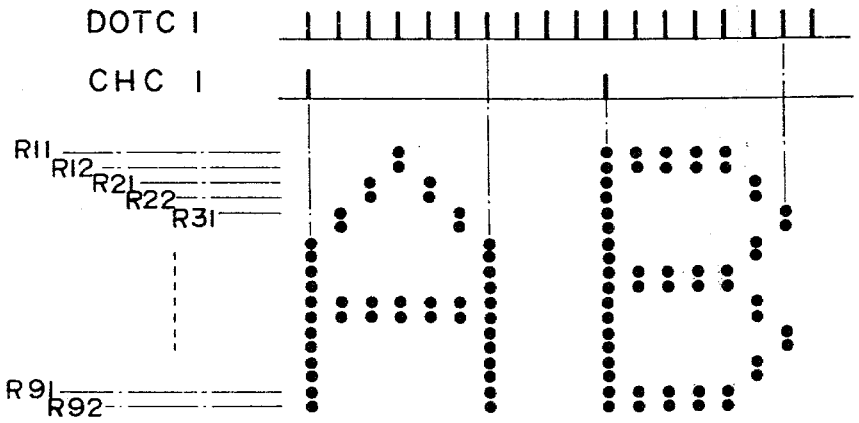
FIG. 3 is explanatory of the principles of the display of the present invention.

FIG. 3 is explanatory of the principles of the display of this invention, showing the case where a character, having a height and width twice that of the displayed character shown in FIG. 2, is displayed. The repetitive periods of the pulses of a dot clock DOTC1 and of a character clock CHC1 are made twice as long by frequency dividing the clock pulses of dot clock DOTC1 and character clock CHC1. Accordingly, without changing the beam scanning speed, the width of the displayed character becomes twice that of the displayed character where the dot clock pulses and the character clock pulses are not frequency divided. Further, by doubling the number of rows as indicated by R11 to R92 and using one row output from the character generator twice, the height of the displayed character becomes twice that of the displayed character in FIG. 2.

Figure 1:
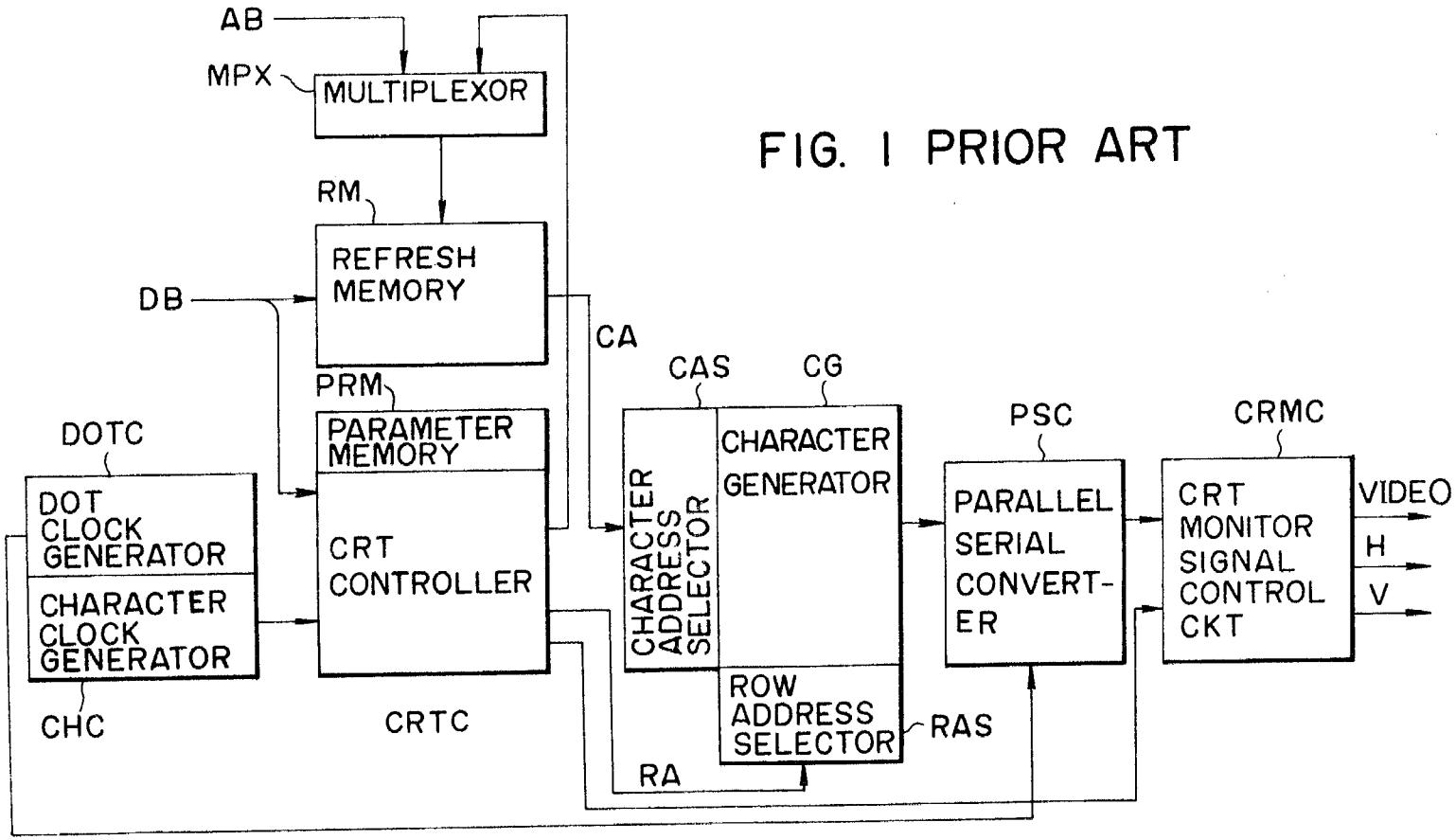
FIG. 1 PRIOR ART
FIG. 1 is a block diagram showing a conventional character display device.
Figure 4:
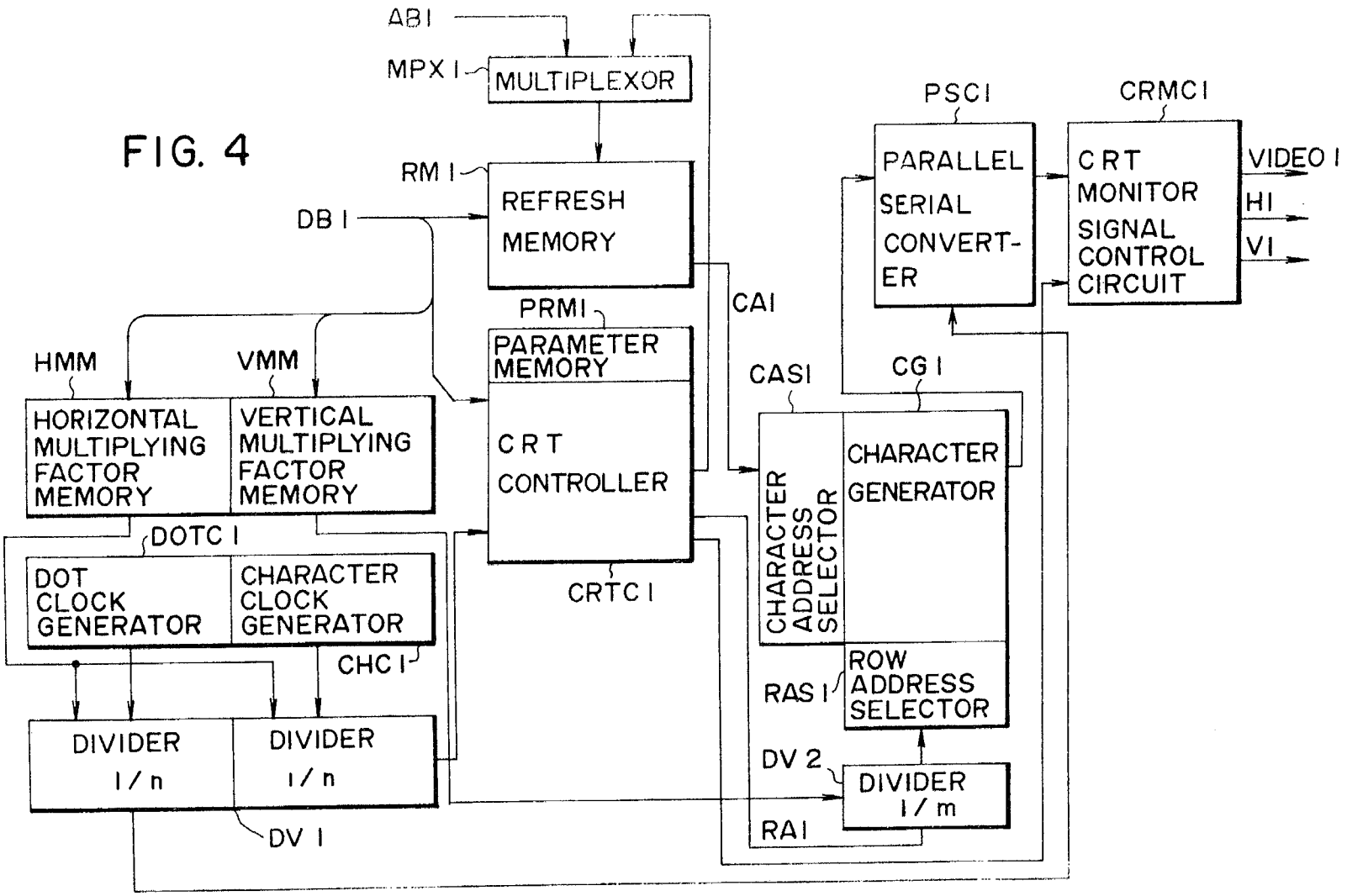
FIG. 4 is a block diagram illustrating an embodiment of this invention.

FIG. 4 illustrates in block form a character display embodying this invention. In FIG. 4, reference character MPX1 indicates a multiplexor; RM1 designates a refresh memory; CRTC1 identifies a CRT controller; PRM1 denotes a memory for setting the aforementioned numbers a, b and c; CG1 represents a character generator; RSC1 designates a parallel-serial converter; CRMC1 refers to a CRT monitor signal control circuit; DOTC1 indicates a dot clock generator; CAS1 identifies a character address selector; RAS1 denotes a row address selector; AB1 represents an address bus; and DB1 designates a data bus. The elements have the same functions as those used in the conventional display shown in FIG. 1. Reference characters DV1 and DV2 indicate dividers provided according to this invention, and HMM and VMM designate memories for setting therein horizontal and vertical multiplying factors, respectively.

In the present invention, data containing the horizontal and vertical multiplying factor is set in the memories HMM and VMM respectively via the data bus DB1. The data set in the memory HMM determines the dividing ratio of the divider DV1. For example, if the multiplying factor is 2, the repetitive frequencies of clock pulses from the clock generators DOTC1 and CHC1 are reduced by $\frac{1}{2}$. The data set in the memory VMM determines the dividing ratio of the divider DV2. If the multiplying factor is 2, the frequency of the row address information pulses from the CRT controller CRTC1 is reduced by $\frac{1}{2}$. As a result of this, the pulses of the dot clock DOTC1 and the character clock CHC1 are frequency-divided by $\frac{1}{2}$ and the row address advances step by step whenever an address modification command is applied twice. In this manner a character twice as large as that shown in FIG. 2 is displayed, as illustrated in FIG. 3. Of course, the multiplying factor may be a number other than 2 and the horizontal and vertical multiplying factors may be selected to be different from each other.

When the multiplying factor is set, the number of characters a to be displayed for each line, the number of lines b for each picture and the number of rasters (rows) c for each character are reset via the data bus DB1 in the parameter memory PRM1. The data bus is connected to a central processing unit (not shown).

That is, when the character clock pulses are accumulated to a, for a characters for one raster, the operation proceeds to the next raster and the row address command RA1 is provided to select dot data of the next row but the row address selector RAS1 does not step forward until the divider DC2 counts m times, so that the dot data of the same row is read out m times. When the number of executions of rasters coincides with the aforesaid number a for the characters of one line, the operation proceeds to scanning of the characters of the next line and the same operations as described above are repeated. When the number of executions of the line coincides with the number b, the operation goes back again to the reading out of the character data of the first line.

As has been described above, in the present invention, by providing frequency dividing means DV1 for frequency dividing the pulses of the dot and character clocks by 1/n (n representing the horizontal multiplying factor of a character to be displayed), and by providing frequency dividing means DV2 for frequency dividing the pulses of a row address command by 1/m, (m representing the vertical multiplying factor of the character), the size of the character to be displayed can be changed at will without modifying the stored content of the character generator. Furthermore, the vertical and horizontal multiplying factors of the character to be displayed can be selected to be different from each other.

It will be apparent that many modifications and variations may be effected without departing from the scope of the novel concepts of this invention.

What is claimed is:

1. A character display comprising:

character generator means for storing characters in the form of a plurality of dots and for outputting row dot data;

A CRT monitor signal control circuit, operatively connected to said character generator means, for receiving said row dot data and for providing a video signal output;

character address selector means, operatively connected to receive a character address signal and operatively connected to said character generator means, for selecting the address of a character stored in said character generator means;

row address selector means, operatively connected to said character generator means and operatively connected to receive a row address pulse signal, for providing a row address signal to said character generator means;

dot clock generator means, operatively connected to said CRT monitor signal control circuit, for providing dot clock pulses for synchronizing the read out of said video signal output;

character clock generator means, operatively connected to said character address selector means, for providing character clock pulses for synchronizing the receipt of said character address signal by said character address selector means;

first means, operatively connected between said dot clock generator means and said CRT monitor signal control circuit, for dividing the frequency of said dot clock pulses by an integer and for providing the frequency divided dot clock pulses to said CRT monitor signal control circuit;

second means, operatively connected between said character clock generator means and said character address selector means, for dividing the frequency of said character clock pulses by an integer and for providing the frequency divided character clock pulses to said character address selector means;

third means, operatively connected to said second means and said row address selector means, for dividing the frequency of said row address pulse signal by an integer and for providing the divided row address pulse signal to said row address selector means, whereby the size of the characters generated by said character display is altered to obtain a desired size character.

2. A character display according to claim 1, further comprising first memory means, operatively connected to said first and second means, for supplying, as the integer, a horizontal multiplying factor to said first and second means.

3. A character display according to claim 1, further comprising second memory means, operatively connected to said third means for providing as the integer, a vertical multiplying factor to said third means.

4. A character display comprising:

a data bus for providing display data;

refresh memory means, operatively connected to said data bus, for storing character data and for outputting a character address signal;

first memory means, operatively connected to said data bus, for storing a horizontal multiplying factor;

second memory means, operatively connected to said data bus, for storing a vertical multiplying factor;

a CRT controller circuit, operatively connected to said refresh memory means and said data bus, for providing, as an output, a row address pulse signal and for controlling the output of said character address signal by said refresh memory means;

parameter memory means, operatively connected to said CRT controller circuit, for storing parameter data and for providing said parameter data to said CRT controller circuit;

a multiplexer, operatively connected between said CRT controller circuit and said refresh memory means;

character address selector means, operatively connected to said refresh memory means, for receiving said character address signal;

character generator means, operatively connected to said character address selector means, for storing characters in the form of a plurality of dots and for providing a row dot data output for a selected character in dependence upon said character address signal;

a parallel to serial converter circuit, operatively connected to said character generator means, for receiving said row dot data output and for providing a serial output;

row address selector means, operatively connected between said character generator means and said CRT controller circuit, for providing row address selection signal to said character generator means;

a dot clock generator, operatively connected to said parallel to serial converter circuit, for generating dot clock pulses for synchronizing said serial output;

first divider means, operatively connected to said first memory means and operatively connected between said dot clock generator and said parallel to serial converter, for dividing the frequency of said dot clock pulses by said horizontal multipyling factor and for providing a divided dot clock pulse output to said parallel to serial converter circuit;

a character clock generator, operatively connected to said CRT controller circuit, for generating character clock pulses for synchronizing the operation of said character address selector means;

second divider means, operatively connected to said first memory means and operatively connected between said character clock generator and said CRT controller circuit, for dividing the frequency of said character clock pulses by said horizontal multiplying factor and for providing a divided character clock pulse output to said CRT controller circuit;

third divider means, operatively connected to said second memory means and operatively connected between said row address selector means and said CRT controller circuit, for dividing the frequency of said row address pulse signal by said vertical multiplying factor and for providing a divided row address pulse signal to said row address selector means;

a CRT monitor signal control circuit, operatively connected to said parallel to serial converter circuit and said CRT controller circuit, for providing a video signal output, whereby the size of the characters generator by said character display is altered to obtain a desired size character.

* * * * *

UNITED STATES PATENT AND TRADEMARK OFFICE

CERTIFICATE OF CORRECTION

PATENT NO. : 4,357,604

DATED : NOVEMBER 2, 1982

INVENTOR(S) : RYOJI IMAZEKI ET AL.

It is certified that error appears in the above-identified patent and that said Letters Patent is hereby corrected as shown below:

Front page, [75] Inventors, delete "both of Hachioji;"; and change "Hino, all of" to --all of Tokyo,--.
[56] References Cited, "Soga" should be --Suga--.

Col. 1, line 15, "having" should be --changing--;
line 19, after "practice" delete ",";
line 58, "a" should be --a--;
line 59, "b" should be --b--;
line 60, "c" should be --c--.
Col. 2, line 10, "a" should be --a--;
line 21, "a" should be --a--;
line 26, "b" should be --b--;
line 42, "date" should be --data--.
Col. 3, line 14, "a, b and c" should be --a, b and c--;
line 49, "a" should be --a--;
line 50, "b" should be --b--;
line 51, "c" should be --c--; and after "character" insert --,--;
line 55, "a" (both occurrences) should be --a--;
line 62, "a" should be --a--;
line 66, "b" should be --b--.
Col. 4, line 7, after "1/m" delete ",".

Signed and Sealed this

Twenty-sixth Day of April 1983

[SEAL]

Attest:

GERALD J. MOSSINGHOFF

Attesting Officer

Commissioner of Patents and Trademarks